United States Patent [19]

Caldwell et al.

[11] 4,428,805

[45] * Jan. 31, 1984

[54] ELECTRODES FOR OXYGEN MANUFACTURE

[75] Inventors: Donald L. Caldwell; Mark J. Hazelrigg, Jr., both of Lake Jackson, Tex.

[73] Assignee: The Dow Chemical Co., Midland, Mich.

[ * ] Notice: The portion of the term of this patent subsequent to Jan. 8, 2000 has been disclaimed.

[21] Appl. No.: 295,352

[22] Filed: Aug. 24, 1981

[51] Int. Cl.[3] ..... C25B 1/02; C25B 11/06

[52] U.S. Cl. ..... 204/129; 204/290 F

[58] Field of Search ..... 204/290 F, 290 L, 291, 204/129; 427/126.3, 126.6

[56] References Cited

U.S. PATENT DOCUMENTS

| | | | |
|---|---|---|---|
| 3,706,644 | 12/1972 | Martinsons | 204/98 |
| 3,711,382 | 1/1973 | Anthony | 204/290 L |
| 3,956,083 | 5/1976 | Cook | 204/95 |
| 3,962,068 | 6/1976 | Zollner et al. | 204/290 F |
| 3,977,958 | 8/1976 | Caldwell et al. | 204/252 |
| 4,040,939 | 8/1977 | Schenker et al. | 204/290 F |
| 4,061,549 | 12/1977 | Hazelrigg et al. | 204/98 |
| 4,125,449 | 11/1978 | Lewis et al. | 204/290 F |
| 4,142,005 | 2/1979 | Caldwell et al. | 204/290 F X |
| 4,366,042 | 12/1982 | Caldwell et al. | 204/290 F |
| 4,368,110 | 1/1983 | Caldwell et al. | 204/290 F |
| 4,369,105 | 1/1983 | Caldwell et al. | 204/290 F |

*Primary Examiner*—F. Edmundson

*Attorney, Agent, or Firm*—W. J. Lee

[57] ABSTRACT

Electroconductive substrates for use as oxygen electrodes are coated with an optional interface layer and then with cobalt oxide spinels conforming substantially to the empirical formula $$M_xZ_yCO_{3-(x+y)}O_4$$

where M represents at least one metal from the Groups IB, IIA, IIB, where Z represents at least one metal from Group IA where x is equal to or greater than zero but not greater than 1, where y is equal to or greater than zero but not greater than 0.5, and where (x plus 2y) is equal to or greater than zero but not greater than 1. The composites are prepared by thermally oxidizing metal oxide precursors in-situ on the substrate, including, optionally, modifier metal oxide materials as a separate dispersed phase in the contiguous spinel structure. The interface layer comprises at least one oxide of Pb, Sn, Sb, Al, In, or mixtures of these. The electrodes are used as the anodic means in an electrolysis cell wherein oxygen is produced by electrolyzing an oxygen-containing electrolyte.

18 Claims, No Drawings

ELECTRODES FOR OXYGEN MANUFACTURE

BACKGROUND OF THE INVENTION

Various cobalt oxide spinels coated onto electrically-conductive substrates, especially for use as anodes in brine electrolysis, are known. Of particular relevancy are U.S. Pat. Nos. 3,977,958; 4,061,549; and 4,142,005; all of which are incorporated herein by reference.

Also of various degrees of relevancy are U.S. Pat. Nos. 4,073,873; 3,711,382; 3,711,397; 4,028,215; 4,040,939; 3,706,644; 3,528,857; 3,689,384; 3,773,555; 3,103,484; 3,775,284; 3,773,554; 3,632,498; and 3,663,280.

Nickel is well known as the standard anode material for commercial water electrolyzers because of its good chemical stability in the alkaline electrolyte (e.g., 25% KOH) normally employed. However, the over-voltage for $O_2$ evolution on Ni is high and increases in service, so improved electrocatalysts are desired. Electrode coatings of mixed Ru-Ti oxides (e.g., U.S. Pat. No. 3,632,498 and others) are very good anodes for production of chlorine from NaCl brine, which is acidic; these anodes are also good for production of oxygen from acidic solutions, e.g., $H_2SO_4$ solutions. However, their chemical stability in strongly alkaline environment, as in commercial water electrolyzers, is inadequate. Graphite is historically well known as a useful anode for $Cl_2$ production, but is rapidly destroyed by oxygen if used for water electrolysis.

British Pat. No. 1,461,764 discloses methods of preparing anode coatings of nickel-cobalt spinel, $NiCO_2O_4$. The use of these anodes for alkaline water electrolysis has been proposed (see, for example, pp. 63–76 and 161–168 in the *Proceedings of the Symposium on Industrial Water Electrolysis,* S. Srinivasan, F. J. Salzano, and A. R. Landgrebe, Eds;, Proceedings Volume 78-4 of The Electrochemical Society, Inc., Princeton, N.J.). This anode material has not met with commercial acceptance, possibly because the recommended manufacturing method involves uneconomical materials and procedures (e.g., freeze-drying, Teflon-bonding).

It has now been found that electrodes coated with cobalt-containing spinel, described hereinafter, are especially suitable and economical for the production of oxygen by the electrolysis of alkaline, neutral, or acid solutions or non-aqueous solutions of adequate conductivity.

SUMMARY OF THE INVENTION

An insoluble anode for manufacturing oxygen by electrolysis, especially by electrolysis of water, is prepared by coating an electroconductive substrate with a first optional coating comprising one or more oxides of the group of metals consisting of Sn, Pb, Sb, Al, and In, and then an outer coating comprising an effective amount of a monometal or polymetal oxide having a spinel structure conforming substantially to the empirical formula comprising $M_xZ_yCo_{3-(x+y)}O_4$, where $0 \leqq x \leqq 1$, $1 \leqq y \leqq 0.5$, $0 \leqq (x+2y) \leqq 1$, where M represents at least one metal of Groups IB, IIA, and IIB of the Periodic Table and where Z represents at least one metal of Group IA. The spinel coating optionally contains a modifier metal oxide. The coating is prepared by applying a fluid mixture of the metal oxide precursors to the substrate and heating under oxidizing conditions at a temperature in a range effective to form the optional interface coating and the second (spinel) coating in-situ on the substrate. A "polymetal" cobalt spinel is used herein to describe a spinel containing a plurality of metals, of which cobalt is one.

DESCRIPTION OF THE INVENTION

Cobalt oxide based anode coatings of the spinel type are sensitive to preparation temperature. Anodes prepared at temperatures above 450° C. tend to have high operating potentials in service; furthermore, these potentials tend to increase more rapidly than those of anodes prepared at lower temperatures. It has been found that the anodes of the present invention, when the optional interface layer is used, are more tolerant of high preparation temperatures than are those of the prior art. A high temperature yields a tougher, more highly sintered active coating, and is thus desirable, if low operating potentials can be maintained. Anodes prepared by omitting the optional, but preferred, interface coating are operable.

It is believed that the cobalt oxide based anode coatings of the spinel type are sufficiently permeable to oxygen at elevated temperatures that oxidation of the electroconductive substrate (typically a valve metal such as titanium) can take place during the coating operation. It is well known that valve metal oxides are poor electrical conductors in the anodic direction; thus such high-temperature anodes have undesirably high resistances and thus high operating potentials.

It is believed that the optional, but preferred, interface layer of the present invention functions by reacting with the valve metal oxide as it is formed on the surface of the substrate, rendering it electrically conductive. The mechanism by which this is accomplished is uncertain. Trivalent metals such as indium may function as conventional semi-conductor dopants in the (tetravalent) valve metal oxide lattice; tetravalent metals such as tin may form conductive solid solutions with the valve metal oxide, analogous to $RuO_2$-$TiO_2$ solid solutions.

One feature that distinguishes the present preferred embodiment of the invention from interface layers of platinum group metals and/or oxides is that the optional interface materials of the present invention cannot in themselves form the basis of an operable anode coating: tin oxide can be used as a dopant in solid solution anode coatings but is insufficiently stable to be used alone, and antimony and indium oxides are highly reactive in typical water electrolysis anolyte. It is thus unexpected that their presence in interface layers stabilizes the operation of anodes in water electrolysis.

In general, the optional interface layer of metal oxide coating is prepared on a cleaned, oxide-free, electroconductive substrate, such as titanium, by applying to the substrate a layer of precursor metal compound which, when thermally decomposed in air, yields the oxide of the metal affixed in-situ on the substrate. More than one of the optical metal oxide precursors may be used simultaneously, so long as the precursor comprises at least one thermally decomposable compound of Sn, Pb, Sb, Al, In or mixtures of these. The precursor may be a metal-organic, or otherwise contain organic moieties, but is preferably an inorganic compound. It is preferred that the precursor metal compound be carried in a liquid medium, such as water, alcohol, water/alcohol, water/acetone, and the like; preferably the precursor metal compound is soluble in the liquid medium. During the heating step of the process the liquid carrier is boiled away and plays no further part in the process. The steps of applying the metal oxide precursors, followed by heating to create the metal oxides, is beneficially repeated one or more times, thereby assuring that a contiguous well-adhered coating of the metal oxide be obtained, though only one coat is operable. It is best if this metal oxide underlayer has a thickness in the range of about 20–400 Å; coatings as thin as about 10 Å demonstrate operability as do coatings thicker than 400 Å but there are no additional benefits to be derived from such thicker coatings which are commensurate with the expense of laying down such thicker coatings. The temperature used in forming the metal oxide underlayer may be from the decomposition temperature (in air) of the metal oxide precursor to as high as several hundred degrees centigrade, preferably a temperature in the range of about 200° C. to about 450° C., most preferably about 250°–450° C. The baking time is generally in the range of about 1.5 to about 60 minutes, the higher temperatures requiring the lesser times. Excess time at the higher temperatures can lead to unwanted oxidation of the substrate.

In general, the outer, active spinel coating is prepared in-situ on the so-coated electroconductive substrate or on a clean, uncoated substrate by applying thereto a fluid mixture (preferably a solution) of the spinel-forming precursors along with, optionally, any modifier metal oxide precursors desired, then heating at a temperature and for a time effective to produce the spinel structure as a layer or coating on the pre-coated substrate or the substrate itself. The spinel coating is found to form a contiguous, well-adhered layer on the undercoating of metal oxide optionally applied first or on the substrate itself.

The temperature effective in producing the spinel structure is generally in the range of about 200° C. to about 475° C., preferably in the range of about 250° C. to about 400° C. At temperatures below about 200° C. the formation of the desired spinel structure is likely to be too slow to be feasible and it is likely that substantially no spinel will be formed, even over extended periods of time. At temperatures above about 475° C. there is likely to be formed other cobalt oxide structures, such as cobaltic oxide ($CO_2O_3$) and/or cobaltous oxide (CoO), whether substituted or not. Any heating of the spinel above about 450° C. should be of short duration, say, not more than about 5 minutes, to avoid altering the desired spinel structures to other forms of the metal oxides. Any modifier metal oxides present, being contained in the spinel structure as a different phase, will be formed quite well at the spinel-forming temperatures and any variations in the oxide form of the modifier metal oxides are not significant in the present invention. By using the optional undercoat preferred in the present invention, the preferred temperature range for formation of the spinel topcoat becomes about 400° C.–450° C., most preferably about 400° C.–425° C.

The length of time at which the heating is done to form the spinel structure is, generally, inversely related to the temperature. At lower temperatures within the prescribed range, the time may be as much as 8 hours or more without destroying the spinel structure or converting substantial amounts of it to other oxide forms. At the upper end of the prescribed heating range, the time of heating should not be extended beyond the time needed to form the desired spinel structure because extended heating times may destroy or convert a substantial amount of the spinel to other oxide forms; at the upper end of the range a heating time in the range of about 1 minute to about 5 minutes is generally satisfactory in forming the spinel without forming other oxide forms.

The substrates of greatest interest in the present invention are electroconductive metals, especially those comprising the valve metals or film-forming metals which includes titanium, tantalum, zirconium, molybdenum, niobium, tungsten, hafnium, and vanadium or alloys thereof. Titanium is especially preferred as a substrate for preparing anodes to be used in electrolysis. Other electroconductive substrates within the purview of this invention are, e.g., nickel, nickel alloys, steels, and stainless steels.

The precursor cobalt compounds used in making the present spinel structures may be any thermally-decomposable oxidizable compound which, when heated in the prescribed range, will form an oxide of cobalt. The compound may be organic, such as cobalt octoate (e.g., cobalt 2-ethyl hexanoate) and the like, but is preferably an inorganic compound, such as cobalt nitrate, cobalt hydroxide, cobalt carbonate, and the like. Cobalt nitrate is especially preferred.

The precursor metal compounds of Groups IA, IB, IIA, and IIB and of the modifier metal oxides (if used) may be any thermally-decomposable oxidizable compound which, when heated in the prescribed range, will form oxides. Organic metal compounds may be used, but inorganic metal compounds are generally preferred.

Modifier oxides may be incorporated into the substituted or unsubstituted $CO_3O_4$ coating to provide a tougher coating. The modifier oxide is selected from among the following listed groups:

Group III-B (Scandium, Yttrium)
Group IV-B (Titanium, Zirconium, Hafnium)
Group V-B (Vandium, Niobium, Tantalum)
Group VI-B (Chromium, Molybdenum, Tungsten)
Group VII-B (Manganese, Technetium, Rhenium)
Lanthanides (Lanthanum through Lutetium)
Actinides (Actinium through Uranium)
Group III-A Metals (Aluminum, Gallium, Indium, Thallium)
Group IV-A Metals (Germanium, Tin, Lead)
Group V-A Metals (Antimony, Bismuth).

The modifier oxide is, preferably, an oxide of cerium, bismuth, lead, vanadium, zirconium, tantalum, niobium, molybdenum, chromium, tin, aluminum, antimony, titanium, or tungsten. Mixtures of modifier oxides may also be used.

Most preferably, the modifier oxide is selected from the group consisting of zirconium, vanadium, and lead, or mixtures of these, with zirconium being the most preferable of these.

The amount of modifier oxide metal or metals may be in the range of zero to about 50 mole %, most preferably about 5 to about 20 mole % of the total metal of the coating deposited on the electroconductive substrate. Percentages, as expressed, represent mole percent of metal, as metal, in the total metal content of the coating. The modifier oxide is conveniently prepared along with the substituted or unsubstituted $CO_3O_4$ from thermally decomposable oxidizable metal compounds, which may be inorganic metal compounds or organic metal compounds.

The carrier for the precursor metal compounds is preferably water, a mixture of water/acetone, or a mixture of water and a water-miscible alcohol, e.g., methanol, ethanol, propanol, or isopropanol. The carrier is one which readily evaporates during spinel formation. The precursor metal compounds are preferably soluble in the carrier or at least in very finely-divided form in the carrier. Solubilizing agents may be added to the mixture, such as ethers, aldehydes, ketones, tetrahydrofuran, dimethylsulfoxide, and the like. In some instances, adjustments to the pH of the mixture may be made to enhance the solubility of the metal compounds, but attention should be given to whether or not the pH adjuster (acid or base) will add any unwanted metal ions. Ammonia is generally the best alkalizer since it does not add metal ions.

The preferred procedure for preparing the coatings comprises starting with a clean substrate with surface oxides and contaminants substantially removed at least on the surface(s) to be coated, then applying the optional interface coating as described above. The mixture of metal oxide spinel precursors in a liquid carrier is applied to the substrate, such as by dipping, spraying, brushing, painting, or spreading. The so-coated substrate is subjected to a temperature in the prescribed range for a period of time to thermally oxidize the metal compounds to oxides, thereby forming, on the interface coating, the spinels of the present invention, along with any modifier metal oxides or second-phase metal oxides which may be co-prepared but which are not part of the expanded cobalt oxide spinel crystal structure. Generally, the first such application (which usually gives a relatively thin layer) is done quickly to avoid the risk of excessive oxidation of the substrate itself. Then as additional applications are made (i.e., applications of the precursor liquid carrier containing the metal compounds, followed by thermal oxidation) the thickness of the coating builds up, becomes tighter and denser, and there is a substantially reduced risk of excessively oxidizing the substrate under the interface coating and the spinel coating. Each subsequent layer is found to combine quite readily to preceding layers and a contiguous spinel coating is formed which is adhered quite well to the interface on the substrate. It is preferred that at least 3 such layer-applications are employed, especially from about 6 to about 12 such layer-applications. If the optional interface layer is omitted, the procedure is substantially the same, taken care not to overheat each application of spinel layer which could cause excessive oxidation of the substrate.

It is best to charge the initial mixture of metal compounds into the liquid carrier in such a way that the desired ratio of metals are present on a molar basis to satisfy the stoichiometry of the desired polymetal cobalt spinel, also referred to herein as expanded cobalt spinel or substituted cobalt spinel.

The following enumerated paragraphs are presented to offer a simplified explanation, based on belief and experience, of what transpires when one or more monovalent or divalent metal ions replace a portion of the cobalt ions in a cobalt oxide spinel, but the invention is not meant to be limited by, or confined to, this simplified explanation. This explanation is intended to cover metals of Groups IA, IIA, IB, and IIB insofar as replacement of cobalt ions in a cobalt oxide spinel structure is concerned.

1. A "single-metal" cobalt oxide spinel, $Co_3O_4$, is understood as having, per molecule, one $Co^{++}$ ion and two $Co^{+++}$ ions to satisfy the valence requirements of four $O^{--}$ ions; thus the single metal cobalt spinel may be illustrated by the empirical formula $Co^{++}Co_2^{+++}O_4^{--}$ to show the stoichiometric valence balance of cobalt cations with oxygen anions.

2. When divalent metal ions are substituted into the cobalt oxide spinel structure, they tend to replace divalent cobalt ions. For example when $Mg^{++}$ is substituted into the $Co_3O_4$ spinel structure, it replaces $Co^{++}$ giving a spinel illustrated by the empirical formula $Mg^{++}Co_2^{+++}O_4^{--}$.

3. When monovalent metal ions are substituted into the cobalt oxide spinel structure they tend to replace divalent cobalt ions. The maximum monovalent ion substitution may be illustrated as, for example, $Li_{0.5}^{+}Co_{2.5}^{+++}O_4$, to show stoichiometric valence balance. The empirical formula may be illustrated as, for example, $Li_yCo_{3-y}O_4$, where y is not more than 0.5, 3−y is at least 2.5, and where (y times Li valence) plus (3−y times cobalt valence) equals 8.

4. When two or more divalent metal ions are substituted into the cobalt oxide spinel structure, then the structure can be written, empirically, as $M_xM'_{x'}Co_{3-(x+x')}O_4$ or as, e.g., $M_xM'_{x'}M''_{x''}Co_{3-(x+x'+M'')}O_4$.

5. When two or more monovalent metal ions are substituted into the cobalt oxide structure, then the structure can be written, empirically, as $Z_yZ'_{y'}Co_{3-(y+y')}O_4$ or as, e.g., $Z_yZ'_{y'}Z''_{y''}Co_{3-(y+y'+y'')}O_4$.

6. When at least one monovalent metal ion and at least one divalent ion are substituted into the cobalt oxide spinel structure, then the structure can be written, empirically, as $M_xZ_yCo_{3-(x+y)}O_4$ or as, e.g., $M_xM'_{x'}Z_yCo_{3-(x+x'+y)}O_4$ or, e.g., as $M_xM'_{x'}Z_yZ'_{y'}Co_{3-(x+x'+y+y')}O_4$.

7. If an excess of monovalent and/or divalent metal ions are present in the mixture from which the substituted cobalt oxide structures are prepared, the excess metal values tend to form a separate metal oxide phase which is not a spinel structure but which is present with the spinel structure.

8. It will be understood by practitioners of these arts that there may be some degree of imperfect spinel crystals which, if they could be isolated and measured separately may not conform exactly to the empirical structures written in this disclosure, but the spinel products prepared according to this invention can be said to conform substantially to the empirical formulae shown.

9. If metal values are in the mixture (from which the spinel structures are formed) which do not effectively replace cobalt ions in the cobalt oxide spinel structure, these metals tend to form separate metal oxide phases which act as modifiers of the spinel structures. For instance, where the spinel structures are formed by building up a contiguous layer of the spinel on a substrate by repeated applications of spinel-forming ingredients, each application being followed by the heating step, the modifier metal oxides are beneficial in providing toughness and abrasion-resistance to the layer. The amount of modifier metal oxides should be limited so that the desired spinel is the predominent ingredient of the coating.

The metals of the relevant groups of the Periodic Table are as follows:

| IA | IIA | IB | IIB |
|---|---|---|---|
| Li | Be | Cu | Zn |
| Na | Mg | Ag | Cd |
| K | Ca | Au | Hg |
| Rb | Sr | | |

-continued

| IA | IIA | IB | IIB |
|---|---|---|---|
| Cs | Ba | | |
| Fr | Ra | | |

Operative upper limits for molar percentage of the M and Z metals which form polymetal spinels with cobalt are, based on total metal content of the spinel: $M \leqq 33.3\%$, $Z \leqq 16.7\%$, and $M+Z \leqq 33.3\%$. Any excess of M and Z will form a separate phase of the metal oxide amongst the spinel crystals. When M metals are used in the coating, it is preferred that on a molar metal basis M is at least 8%. When Z metals are used in the coating, it is preferred that on a molar metal basis Z is at least 4%.

The following embodiments are to illustrate the invention, but the invention is not limited to the particular embodiments shown.

EXPERIMENTAL

The type of alkaline (KOH) test cell utilized in Example 2 was a vertical diaphragm cell with equal anolyte and catholyte levels. The diaphragm was deposited from an asbestos slurry into a foraminous steel cathode in the conventional manner. Anode and cathode were each approximately 3"×3" (7.62 cm×7.62 cm). Current was brought to the electrodes by a brass rod brazed to the cathode and a titanium rod welded to the anode. The distance from the anode to the diaphragm face was approximately ¼ inch (0.635 cm). Temperature of the cell was controlled by means of a thermocouple and heater placed in the anolyte compartment. The cell was started up on 20 wt% KOH solution. Water or 20 wt% KOH solution was added periodically to the cell to maintain a 20 wt% KOH strength. Hydrogen and oxygen were withdrawn continuously from the cell. Power was supplied to the cell by a current regulated power supply. Electrolysis was conducted at apparent current densities of 0.5 to 1.0 ampere per square inch (6.45 $cm^2$) anode area.

The etching solution employed in the examples below was prepared by mixing 25 ml analytical reagent hydrofluoric acid (48% HF by weight), 175 ml analytical reagent nitric acid (approximately 70% $HNO_3$ by weight), and 300 ml deionized $H_2O$.

Anode potentials in Examples 1 and 3 were measured in a laboratory cell specifically designed to facilitate measurements on 3"×3" (7.62×7.62 cm) anodes. The cell is constructed of plastic. Anode and cathode compartments are separated by a commercial PTFE membrane. The anode compartment contains a heater, a thermocouple, a thermometer, a stirrer, and a Luggin capillary probe which is connected to a saturated calomel reference electrode located outside the cell. The cell is covered to minimize evaporative losses. Potentials are measured with respect to saturated calomel at ambient temperature (25°-30° C.). Lower potentials imply a lower energy requirement per unit of product produced, and thus more economical operation.

EXAMPLE 1

Fifteen pieces of ASTM Grade I titanium expanded mesh approximately 3"×3"×0.063" (7.62×7.62×0.16 cm) were dipped in 1,1,1-trichloroethane, air dried, dipped in HF-$HNO_3$ etching solution approximately 30 seconds, rinsed with deionized water, and air dried. The mesh was blasted with $Al_2O_3$ grit to a uniform rough surface and blown clean with air. Two interface coating precursor solutions were prepared as follows: Solution (A) contained 15.1 g of $SnCl_4.5H_2O$ dissolved in 5 ml concentrated reagent HCl and 30 ml technical isopropyl alcohol; Solution (B) contained 2.03 g $SbCl_3$ and 15.1 g $SnCl_4.SH_2O$ dissolved in 5 ml concentrated reagent HCl and 30 ml technical isopropyl alcohol. The active spinel coating precursor, Solution (C), was prepared by mixing appropriate quantities of $Co(NO_3)_2.6H_2O$, $Zn(NO_3)_2.6H_2O$, aqueous $ZrO(NO_3)_2$ solution and deionized $H_2O$ to give a mole ratio of 10 Co:5 Zn:1 Zr.

Five sets of anodes were prepared, each containing three samples. Sample (a) of each set contained no interface coating. Sample (b) contains an interface coating of tin oxide obtained from Solution (A). Sample (c) contains an interface coating of tin and antimony oxides obtained from Solution (B).

All interface coatings were prepared at 450° C. For all samples (b) and (c) the specimens were brushed with the appropriate interface solution, baked in a 450° C. convection oven for about ten minutes, removed and cooled in air about ten minutes. One additional interface coat was applied in a similar manner. For sets (1) and (2) Sample (a) was given two coats of active spinel at 450° C. while Samples (b) and (c) were being given their two interface coats.

All fifteen anodes were given eight coats of active spinel in the following manner: the substances treated as described above were brushed with solution (C), placed in a convection oven heated to the temperature listed in Table I below, baked for about ten minutes, removed, and cooled in air about ten minutes. Seven additional coats were applied in a similar manner. After all coats were applied and baked, the anodes were given a final bake at 375° C. for about one hour.

Potentials of the fiften anodes were measured in the laboratory cell described above. The cell was filled with 300 gpl sodium chloride brine solution and heated to about 70° C. and electrolysis was conducted at an apparent current density of 0.5 ampere per square inch (6.45 $cm^2$) anode area. Results are shown in Table I. It is apparent that the anodes of the present invention having the interface are much less sensitive to preparation temperature than those not having the interface.

TABLE I

| SET/ SAMPLE | Bake Temperature (°C.) Interface Coat[1] | Active Spinel[2] | Final Bake | Interface Coat Oxides | Anode Potential[3] mv. |
|---|---|---|---|---|---|
| 1a | 450[4] | 450 | 375 | NA* | 1340 |
| b | 450 | 450 | 375 | Sn | 1125 |
| c | 450 | 450 | 375 | Sn + Sb | 1112 |
| 2a | 450[4] | 425 | 375 | NA | 1188 |
| b | 450 | 425 | 375 | Sn | 1098 |
| c | 450 | 425 | 375 | Sn + Sb | 1089 |
| 3a | NA | 400 | 375 | NA | 1102 |
| b | 450 | 400 | 375 | Sn | 1097 |
| c | 450 | 400 | 375 | Sn + Sb | 1092 |
| 4a | NA | 375 | 375 | NA | 1095 |
| b | 450 | 375 | 375 | Sn | 1097 |
| c | 450 | 375 | 375 | Sn + Sb | 1089 |
| 5a | NA | 350 | 375 | NA | 1090 |
| b | 450 | 350 | 375 | Sn | 1094 |
| c | 450 | 350 | 375 | Sn + Sb | 1094 |

*NA means not applied.
[1]Two coats.
[2]Eight coats.
[3]Anode potential is measured in millivolts at 0.5ASI, 70° C. VS SCE at 25-30° C.
[4]Two coats of active spinel precursor.

The above anodes are found to be useful and operable as oxygen anodes in producing oxygen by electrolysis of KOH, NaOH, $Na_2SO_4$, and others.

EXAMPLE 2

A piece of ASTM grade 1 titanium expanded mesh approximately 3"×3"×0.063" (7.62×7.62×0.16 cm) was dipped in 1,1,1-trichloroethane, air dried, dipped in HF-$HNO_3$ etching solution approximately 20 seconds, rinsed with deionized water, and air dried. The mesh was blasted with $Al_2O_3$ grit to a uniform rough surface and blown clean with air. The coating solution was prepared by mixing appropriate quantities of $CO(NO_3)_2.6H_2O$, $Zn(NO_3)_2.6H_2O$, aqueous $ZrO(NO_3)_2$ solution, and deionized $H_2O$ to give a 10:5:1 Co:Zn:Zr mole ratio. The titanium sheet was brushed with the coating solution, baked in a 375° C. convection oven for about ten minutes, removed, and cooled in air about ten minutes. Ten additional coates were applied in a similar manner. A twelfth coat was applied and baked 60 minutes at 375° C.

The oxygen anode potential was determined, utilizing the measurement cell described above. The anode was then placed in the diaphragm water electrolysis cell described above and operated continuously for 108 days at 0.5 ampere per square inch at 70° C. The cell current density was then raised to 1.0 ampere per square inch (70° C.) and the cell operated for an additional 133 days. The cell ran at a steady 1.9 volts at 0.5 amperes per square inch and a steady 2.1 volts at 1.0 amperes per square inch. At the end of the test the anode coating had gained 1.8% in weight.

EXAMPLE 3

The oxygen anode potentials of $RuO_2.TiO_2$, $Co_3O_4$, $Co_2ZnO_4$, and $Co_2ZnO_4.0.2\ ZrO_2$ minicell anodes were measured in 1.5 M sodium sulfate solution adjusted to pH's of 1, 3, and 5 with sulfuric acid. The temperature was 70° C. and the current density range was 0.01 to 0.50 amperes per square inch. The experiments were short term and utilized the lab cell described above. Table II below reproduces the data obtained at pH 5. As can be seen, the cobalt oxide based anodes exhibit a 100 mV higher oxygen overvoltage than the $RuO_2$-$TiO_2$ anode at low current densities (0.01 ampere per square inch). The difference in anode potential between the two decreases with increasing current density and for the $Co_2ZnO_4$ anode is approximately the same at 0.5 ampere per square inch.

TABLE II

| Current Density Amp/in$^2$ | Anode Potential (mV vs. SCE (30° C.)) | | | |
|---|---|---|---|---|
| | $RuO_2.TiO_2$ | $Co_3O_4$ | $Co_2ZnO_4$ | $Co_2ZnO_4.0.2\ ZrO_2$ |
| 0.5 | 1299 | 1336 | 1297 | 1345 |
| 0.4 | 1277 | 1316 | 1285 | 1330 |
| 0.3 | 1244 | 1292 | 1270 | 1306 |
| 0.2 | 1212 | 1265 | 1250 | 1287 |
| 0.1 | 1158 | 1225 | 1223 | 1250 |
| 0.09 | 1148 | 1220 | 1218 | 1244 |
| 0.08 | 1140 | 1214 | 1213 | 1236 |
| 0.07 | 1131 | 1207 | 1208 | 1231 |
| 0.06 | 1122 | 1201 | 1201 | 1222 |
| 0.05 | 1110 | 1191 | 1195 | 1214 |
| 0.04 | 1098 | 1181 | 1185 | 1205 |
| 0.03 | 1083 | 1170 | 1176 | 1192 |
| 0.02 | 1065 | 1152 | 1163 | 1180 |
| 0.01 | 1036 | 1127 | 1137 | 1151 |

EXAMPLE 4

A piece of ASTM Grade 1 titanium expanded mesh approximately 3"×3"×0.063" (7.62×7.62×0.16 cm) is dipped in 1,1,1-trichloroethane, air dried, dipped in HF-$HNO_3$ etching solution approximately 30 seconds, rinsed with deionized water, and air dried. The mesh is blasted with $Al_2O_3$ grit to a uniform rough surface and blown clean with air. An interface coating precursor solution is prepared as follows: 1.30 g of $InCl_3.4H_2O$ and 0.009 g $SbCl_3$ are dissolved in 3.2 g concentrated reagent HCl and 20.5 g technical isopropyl alcohol. An active spinel coating precursor, Solution (C), is prepared by mixing appropriate quantities of $Co(NO_3)_2.6H_2O$, $Zn(NO_3)_2.6H_2O$, aqueous $ZrO(NO_3)_2$ solution, and deionized $H_2O$ to give a mole ratio of 10 Co:5 Zn:1 Zr.

The specimen is brushed with the interface solution, baked in a 400° C. convection oven for about ten minutes, removed, and cooled in air about ten minutes. The specimen is then given twelve coats of spinel. Each coat is applied by brushing with spinel coating precursor, baking at 400° C. ten minutes, removing from the oven, and cooling in air about ten minutes. After the twelfth spinel coat has been baked the anode is given a final bake at 375° C. for about one hour.

The anode is found to be useful and operable for producing oxygen in a KOH cell as described above and also in a sodium sulfate cell, either aqueous or non-aqueous.

EXAMPLE 5

Other polymetal spinel outer coatings (especially containing $ZrO_2$ dispersed therein) which are effective as anodic material for producing oxygen by electrolysis and which benefit from the interface layer of oxides of Sn, Sb, Pb, Al, In, or mixtures of these include, for example (approx. values):

| | |
|---|---|
| $Li_{0.5}Co_{2.5}O_4$ | $Li_{0.125}Zn_{0.5625}Cu_{0.1875}Co_{2.125}O_4$ |
| $Li_{0.375}Zn_{0.25}Co_{2.375}O_4$ | $Li_{0.125}Mg_{0.75}Co_{2.125}O_4$ |
| $Li_{0.375}Co_{2.625}O_4$ | $Li_{0.25}Zn_{0.50}Co_{2.25}O_4$ |
| $Li_{0.25}Co_{2.75}O_4$ | $Li_{0.125}Zn_{0.5625}Mg_{0.1875}Co_{2.125}O_4$ |
| $Li_{0.125}Zn_{0.75}Co_{2.125}O_4$ | $Li_{0.125}CO_{2.875}O_4$ |
| $Li_{0.125}Cu_{0.75}Co_{2.125}O_4$ | $ZnCo_2O_4$ |
| $Zn_{0.75}Mg_{0.25}Co_2O_4$ | $Zn_{0.25}Ag_{0.375}Co_{2.375}O_4$ |
| $Zn_{0.5}Co_{2.5}O_4$ | $Zn_{0.25}Co_{2.75}O_4$ |
| $Zn_{0.5}Ba_{0.5}Co_2O_4$ | $Zn_{0.5}Mg_{0.5}Co_2O_4$ |
| $Zn_{0.5}Sr_{0.5}Co_2O_4$ | $Zn_{0.5}Ca_{0.5}Co_2O_4$ |
| $Zn_{0.5}Cu_{0.5}Co_2O_4$ | $Zn_{0.5}Cd_{0.5}Co_2O_4$ |

Other embodiment within the purview of the present invention will become obvious to persons skilled in the art upon reading this disclosure.

Within the purview of the present invention is the production of oxygen by the electrolysis of acidic, neutral, or basic aqueous solutions, and also organic compounds contained in organic and/or inorganic solvents of adequate conductivity. The aqueous solutions may be, e.g., NaOH, KOH, LiOH, $Na_2SO_4$, $H_2SO_4$, $Na_3PO_4$, $Na_2HPO_4$, $NaH_2PO_4$, $H_3PO_4$, and the like. Supporting electrolytes used to increase the conductivity of non-aqueous solutions may be $LiClO_4$, $LiBF_4$, $LiPF_6$, $R_4N^+BF_4^-$, $R_4N^+ClO_4^-$, (R=alkyl), and the like.

Also within the purview of the present invention, using the active anodes described herein, is the preparation of oxygen-containing organic compounds, such as the preparation of benzoquinone by electrolysis of aqueous phenol solution using methods substantially as described in U.S. Pat. No. 3,509,031 or in "Introduction to Organic Electrochemistry" by M. R. Rifi and F. H. Cavitz, published by Marcel Dekker, Inc., New York, 1974. Other such anodic oxidations are also within the purview of the present invention, using the anodes disclosed here.

The anodes of the present invention may be used for electrolysis at ambient temperature and pressure or at elevated temperature and pressure. The electrolyte concentration ranges from saturation down to the lower limit dictated by economics and high cell voltage encountered at low concentration.

We claim:

1. An electrically-conductive composite for use as an anode for oxygen manufacture comprising an electrically-conductive substrate, an interface coating on said substrate, and a polymetal cobalt spinel outer coating, said interface coating comprising a layer of at least one metal oxide of the group consisting of lead oxide, tin oxide, antimony oxide, aluminum oxide, and indium oxide, said polymetal cobalt spinel comprising at least one substituted cobalt oxide spinel conforming substantially to the empirical formula $$M_xZ_yCo_{3-(x+y)}O_4,$$

where M is at least one metal of the Groups IB, IIA, and IIB, wherein Z is at least one metal of Group IA, where x is greater than or equal to zero, but not greater than 1, where y is greater than or equal to zero, but not greater than 0.5, where (x+2y) is greater than zero, but not greater than 1, and where the amounts of M, Z, and Co are sufficient to substantially satisfy the valence requirements of oxygen in the spinel structure.

2. The composite of claim 1 wherein the substrate comprises a valve metal selected from the group consisting of titanium, tantalium, zirconium, molybdenum, niobium, tungsten, hafnium, and vanadium and alloys thereof.

3. The composite of claim 1 wherein the substrate comprises titanium or alloys thereof.

4. The composite of claim 1 wherein M represents one metal, Z represents one metal and (x+2y) equals a value in the range of about 0.5 to about 1.0.

5. The composite of claim 1 wherein M represents two metals and y is zero.

6. The composite of claim 1 where z represents one metal and x is zero.

7. The composite of claim 1 where Z represents two metals and x is zero.

8. The composite of claim 1 wherein the polymetal cobalt spinel is substantially represented by the empirical formula $ZnCo_2O_4$.

9. The composite of claim 1 wherein the polymetal cobalt spinel is substantially represented by the empirical formula $Li_{0.5}CO_{2.5}O_4$.

10. The composite of claim 1 wherein the coating of monometal or polymetal cobalt spinel contains dispersed therein up to about 50%, on a metal-to-metal molar basis, of at least one modifier selected from the oxides of metals of Groups IIB, IV-B, V-B, VI-B, VII-B, III-A, IV-A, V-A, Lanthanides, and actinides.

11. The composite of claim 1 wherein the coating of polymetal cobalt spinel contains dispersed therein up to about 50%, on a metal-to-metal molar basis, of a modifier metal oxide comprising $ZrO_2$.

12. The composite of claim 1 wherein the polymetal cobalt spinel coating comprises $ZnCo_2O_4$ containing dispersed therein a minor amount of a modifier metal oxide comprising $ZrO_2$.

13. The composite of claim 1 wherein the interface coating comprises tin oxide, indium oxide, a mixture of tin oxide and antimony oxide, or a mixture of indium oxide and antimony oxide.

14. The composite of claim 1 wherein the composite is an anode in an oxygen-producing device for electrolyzing alkaline, acid, or neutral aqueous liquids.

15. The composite of claim 1 wherein the composite is an anode for use in the preparation of oxygen-containing organic compounds.

16. The composite of claim 1 wherein the composite is an anode material for use in the electrolytic decomposition of aqueous liquids to produce oxygen.

17. The composite of claim 1 wherein the interface coating comprises a mixture of indium oxide and antimony oxide and the spinel coating comprises $ZnCo_2O_4$ containing dispersed therein a minor amount of a modifier metal oxide comprising $ZrO_2$.

18. A method for oxygen-generation by electrolyzing an oxygen-containing electrolyte in an electrolysis cell containing an ion permeable divider between cathode means and anode means, characterized as having for the anode means at least one composite of claim 1.

* * * * *

UNITED STATES PATENT AND TRADEMARK OFFICE

CERTIFICATE OF CORRECTION

PATENT NO. : 4,428,805

DATED : January 31, 1984

INVENTOR(S) : Donald L. Caldwell and Mark J. Hazelrigg, Jr.

It is certified that error appears in the above—identified patent and that said Letters Patent is hereby corrected as shown below:

Col. 1, line 32 "$NiCO_2O_4$" should be --$NiCo_2O_4$--.
Col. 1, line 60 "$1 \leqq y \leqq 5$" should be --$0 \leqq y \leqq 5$--.
Col. 2, line 58 "optical" should be --optional--.
Col. 3, line 44 "$CO_2O_3$" should be --$Co_2O_3$--.
Col. 4, lines 31 and 61 "$CO_3O_4$" should be --$Co_3O_4$--.
Col. 4, line 36 "Vandium" should be --Vanadium--.
Col. 5, line 15 insert a --,-- after "removed".
Col. 7, line 24 "into" should be --onto--; line 39 "to" should be --and--.
Col. 8, line 35 "fiften" should be --fifteen--.
Col. 9, line 16 "coates" should be --coats--.
Col. 10, line 47 "embodiment" should be --embodiments--.
Col. 11, line 27 "wherein" should be --where--.
Col. 12, line 1 "z" should be --Z--; line 10 "$Li_{0.5}CO_{2.5}O_4$" should be -- $Li_{0.5}Co_{2.5}O_4$--.
Col. 12, line 15 "IIB" should be --IIIB--.

Signed and Sealed this

Tenth Day of July 1984

[SEAL]

Attest:

GERALD J. MOSSINGHOFF

Attesting Officer

Commissioner of Patents and Trademarks